United States Patent [19]

Barber

[11] 3,988,104

[45] Oct. 26, 1976

[54] BURNER CONTROL

[75] Inventor: Roy Barber, Sheffield, England

[73] Assignee: Land Pyrometers Limited, Sheffield, England

[22] Filed: May 7, 1975

[21] Appl. No.: 575,173

[30] Foreign Application Priority Data

May 23, 1974 United Kingdom ..... 23134/74

[52] U.S. Cl. ..... 431/90; 431/12; 431/79

[51] Int. Cl.[2] ..... F23N 5/10

[58] Field of Search ..... 431/12, 90, 59, 79; 137/6, 90

[56] References Cited

UNITED STATES PATENTS

| | | | |
|---|---|---|---|
| 3,241,597 | 3/1966 | Juzi | 431/12 X |
| 3,388,862 | 6/1968 | Gabrielson | 431/12 X |
| 3,734,675 | 5/1973 | Osburn | 431/12 |
| 3,768,955 | 10/1973 | McLaughlin | 431/12 |
| 3,797,988 | 3/1974 | Davidson | 431/12 |

*Primary Examiner*—Edward G. Favors

*Attorney, Agent, or Firm*—Toren, McGeady and Stanger

[57] ABSTRACT

The invention is concerned with a burner monitor comprising a variator which is arranged to cause a predetermined fluctuation of the flow of a reactant to a burner to cause flickering of the burner flame. A detector for radiation from the flame from the burner emits a signal corresponding to the radiation. A comparator assesses the polarity of any correlation between the applied fluctuations and the signal from the detector and an indicator indicates the assessed polarity. The output from the indicator may be integrated to produce a quantitative assessment of the fuel rich or fuel lean flame condition.

24 Claims, 6 Drawing Figures

Time (mins)
90
80
70
60
50
40
30
20
10
0
-5μA
0
+5μA
Integrated Error Current

BURNER CONTROL

The invention relates to burner installations, for example for boilers or furnaces, in which the fuel/air flow ratio at the burner is adjusted to keep the ratio at or close to the stoichiometric combustion ratio as a result of monitoring the burner flame.

In British patent specification No. 1,288,824 burner control means is described in which a variator applies to the flow of a reactant to the burner a predetermined fluctuation of small amplitude compared with the general level of flow of the reactant at low frequency as compared to natural frequency of flame flicker. A detector detects radiation from the flame from the burner and emits a signal corresponding to the radiation. A comparator assesses the polarity of any correlation between the applied fluctuations and the signal from the detector and an adjuster which is responsive to the polarity of the correlation assessed by the comparator automatically adjusts the reactant flow ratio at the burner.

Although this control means enables the proportions of fuel and air or other oxident to the burner or burners of a boiler or furnace to be kept within very close limits of the desired stoichiometric proportions, the permanent fitting of a separate control means for continuously and automatically controlling the reactant flow to each burner is expensive. Furthermore, in multiple burner installations, the reactant flow to a bank of burners is frequently controlled through a common valve or valves and in such cases the control means as described in the aforementioned specification cannot be used because the automatic correction to the flow of one of the reactants would effect all the burners in the bank equally and this is unlikely to lead to a stoichometric reactant ratio at each burner. Usually, however, the individual burners are provided, or can be provided, with a manual adjustment for trimming that burner, that is adjusting the reactant flow ratio at that burner. The control means of the earlier specification cannot however take advantage of such individual trimming.

The burner monitor disclosed in the earlier specification also teaches no means of assessing quantitatively the burner conditions, that is how far from peak radiation conditions the burner is operating in relation to similar burners in the installation, particularly when the burner conditions are continually varying.

There is inevitably a finite modulation signal transmission time through the variator, valve and burner of the burner monitor disclosed in the earlier specification and the fluctuating signal received by the comparator from the detector lags behind the reference signal. The earlier specification gives no assistance in compensating for phase relationships between the two signals at the comparator, resulting from this signal transmission delay.

It is an object of the present invention to provide a burner monitor of the general kind described in British patent specification No. 1,288,824 but providing an open loop system whereby the reactant flow condition at any burner in a multiple burner installation can be assessed and appropriate manual trimming adjustments made.

It is a further object of the present invention to provide a burner monitor which gives an integrated quantitative assessment of any variations in the reactant flow to the burner from a reactant flow ratio corresponding to the desired peak radiation emission condition which occurs at or near to the stoichiometric combustion ratio.

It is a still further object of the present invention to provide a burner monitor in which phase lag between a reference signal and a signal received from a detector which monitors radiation from a burner flame is compensated.

These and other objects are met by the burner monitor which is disclosed herein and which comprises a variator which is arranged to cause a periodic fluctuation, at a frequency between 0.01 and 100 Hz, and preferably between 0.1 and 10 Hz, of the flow of a reactant to a burner, and a dector detects radiation from the flame from the burner and emits a signal corresponding to the radiation. A phase sensitive comparator assesses the polarity of any correlation between the applied fluctuations and the signal from the detector, and an indictor, such as a centre zero meter, indicates the assessed polarity. An adjustable delay circuit is provided between the variator and the comparator for delaying a reference signal corresponding to the applied fluctuations and hence compensating for phase lag introduced by difference in the transmission time of the reference signal and that of the signal received by the comparator via the variator and detector. An integrator is coupled to the comparator and integrates the comparator output, and a quantitative assessment indicator displays the integrated signal. The quantitative assessment indicator my be a centre zero meter and is preferably coupled to a continuous trace chart recorder. A timer is coupled to the integrator and automatically records the time taken for the integrated signal to reach a predetermined value.

The phase sensitive detector detects the presence of an in-phase or anti-phase signal at the applied frequency. The relative phase, that is the polarity of the correlation, of the applied fluctuations and the determined fluctuations of the detected radiation will vary as the mixture of the burner varies on either side of the stoichiometric ratio. For example, lean and rich mixtures of the fuel, whether gaseous, liquid or solid, and air or other oxidant, will result in equal signal frequencies, respectively in-phase and anti-phase, or vice versa, depending upon which is caused to fluctuate. This is fully described in the aforementioned British specification the disclosure of which is incorporated herein.

The means for causing the determined fluctuation in the reactant flow to the burner may incorporate or be fitted to a separate valve controlling the reactant flow. Most simply, however, the variator produces a fluctuating signal which is added to a signal controlling a valve which in turn controls the general level of a reactant flow to the burner. The form of signal is unimportant although the variator preferably produces a fluctuating pneumatic signal to control a pneumatically actuated valve, the variator in turn being controlled by an electrical modulation generator from which the reference signal is fed to the comparator.

The polarity assessment indicator is preferably a visual indicator. Although it may incorporate a system of lights, it is preferably in the form of a centre zero meter, deflection of which in one direction or the other indicates a fuel rich or fuel lean condition. It may also be calibrated to show whether the reactant ratio is within acceptable tolerances. A slave recorder may be coupled to the indicator to give a permanent record.

As well as the qualitive assessment of burner conditions, it is often desirable to obtain a quantative assessment, that is how far from peak radiation condition the burner is operating in relation to similar burners in the installation. This quantitative assessment is achieved by the integrator which is coupled to the comparator and integrates the comparator output. The timer which may be coupled to the integrator for automatically recording the time taken for the integrated signal to reach a predetermined value is inversely proportional to the difference between the actual reactant ratio to that burner and the reactant ratio giving peak radiation emission. The theory of this is disclosed later in this specification. The direction of deflection of the integrator meter depends upon the fuel rich or fuel lean conditions of the flame. Using this technique it is possible to scan a number of burners to determine which burners are supplied with a fuel rich reactant ratio, which with a fuel lean reactant ratio, and to obtain a relative assessment of how fuel rich or how fuel lean the burners are working.

In operation the monitor may be used at intervals and the indicators will be read by the operator, or it may be used for continuous monitoring of a burner, the output being displayed on the slave recorder. Depending upon the readings, appropriate adjustments will be made to one or more reactant flow valves to adjust the reactant flow ratio as desired towards the desired stoichiometric ratio. In addition a signal may be fed back from the integrator to control an adjuster which automatically adjust a valve controlling a reactant flow.

When the instrument is used with a multiburner installation, the variator may be arranged to apply a fluctuation to a common flow of one reactant to all the burners and the radiation from the flame of each burner will be detected in turn, for example, by a narrow angle photoelectric sensor. The necessary manual trimming adjustments will then be made to each burner in turn corresponding to the indicator readings when the detector is focussed on that burner flame.

There is inevitably a finite modulation signal transmission time through the variator, valve and burner, and the fluctuating signal received by the comparator from the detector lags behind the reference signal. This signal transmission delay is compensated by the adjustable delay circuit provided between the modulation generator and comparator for delaying the reference signal. When the adjustable delay in the reference signal is equal to the signal transmission delay, or differs from it by an integral number of periods, the setting is correct. However, considering that the frequency of modulation may be 1 Hz and that it is necessary to match the two signals to within 20° of phase angle, in order to maintain signal strengths from the comparator, the delay must be measured to within 0.06 second. To do this by direct measurement is very difficult. It is preferable therefore if the delay circuit incorporates means controlled by a switch for introducing a 90° phase change into the reference signal. This refinement enables a simple setting up technique. It is known that if there is a 90° phase lag between its two input signals, the comparator output is zero. Initially, then the burner equipment is set up so as to be known to be operating off the peak radiation condition with the reactant ratio fuel rich or fuel lean. The delay in the reference signal is then adjusted until the phase correlation output of the comparator is zero. The two signals must then be 90° out of phase. By means of the switch, a further 90° delay is then added or subtracted to give the fuel lean or fuel rich indication required.

In situations where an oil burning burner is being monitored, there is little delay in signal transmission time through the oil and the delay setting will be constant for all the burners operating off that oil line. However, if a gas burner is being monitored, the delay can vary from burner to burner and the setting up procedure may have to be repeated for each burner.

In order to allow for a manual delay adjustment of no more than 180°, the delay circuit preferably also incorporates means controlled by a switch for incorporating a 180° phase change into the reference signal. Any phase lag can then be compensated.

The radiation detected by the photoelectric sensor, may be the electromagnetic radiation emitted by the flame in the ultraviolet, visible, or infra-red region of the spectrum, or any other radiation from the flame which exhibits variations in magnitude which bear a positive relation to the combustion intensity of the flame and which is capable of translation into an electrical effect by a suitable detector.

An example of a multi-burner installation incorporating a monitor according to the invention is illustrated in the accompanying drawings, in which.

Figure 1:
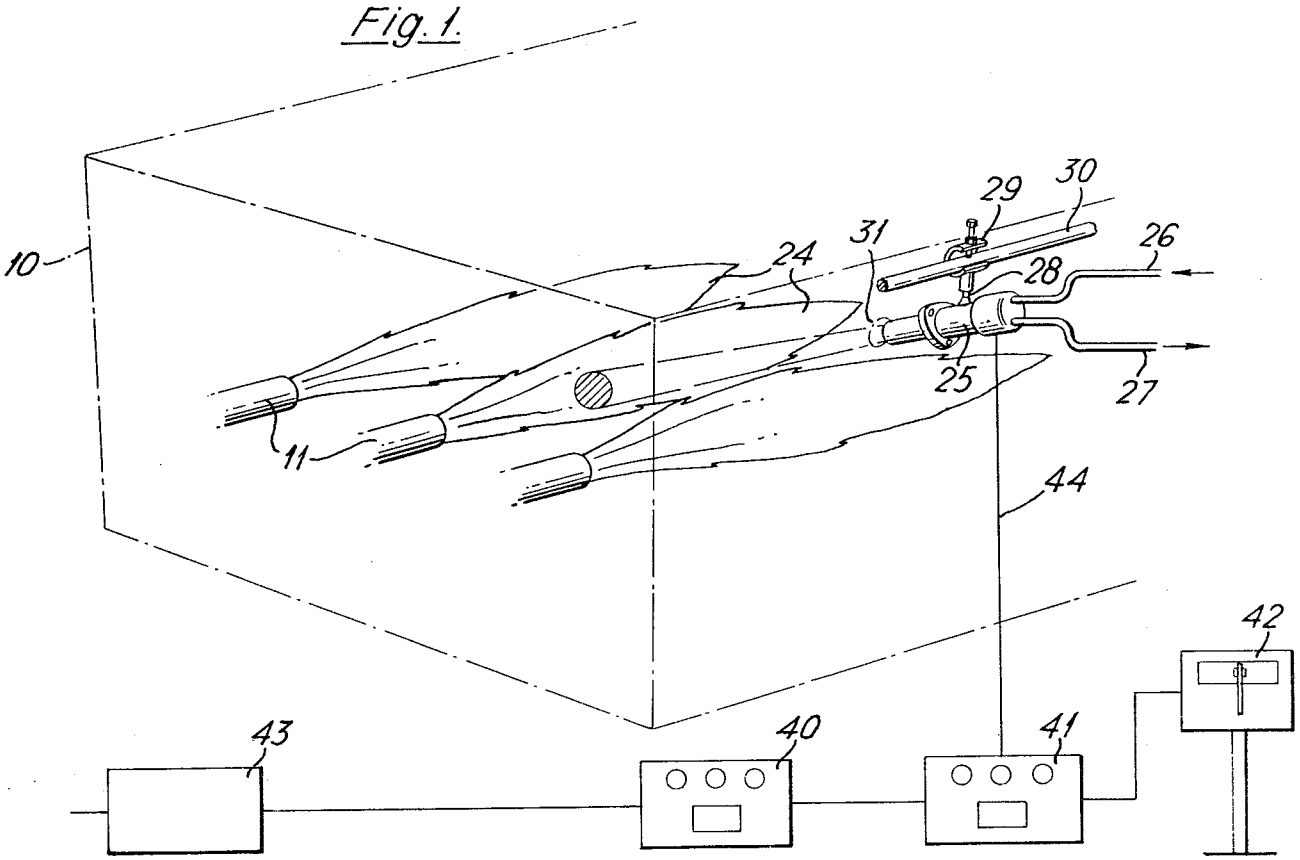
FIG. 1 is a diagrammatic perspective view of the installation.
Figure 2:
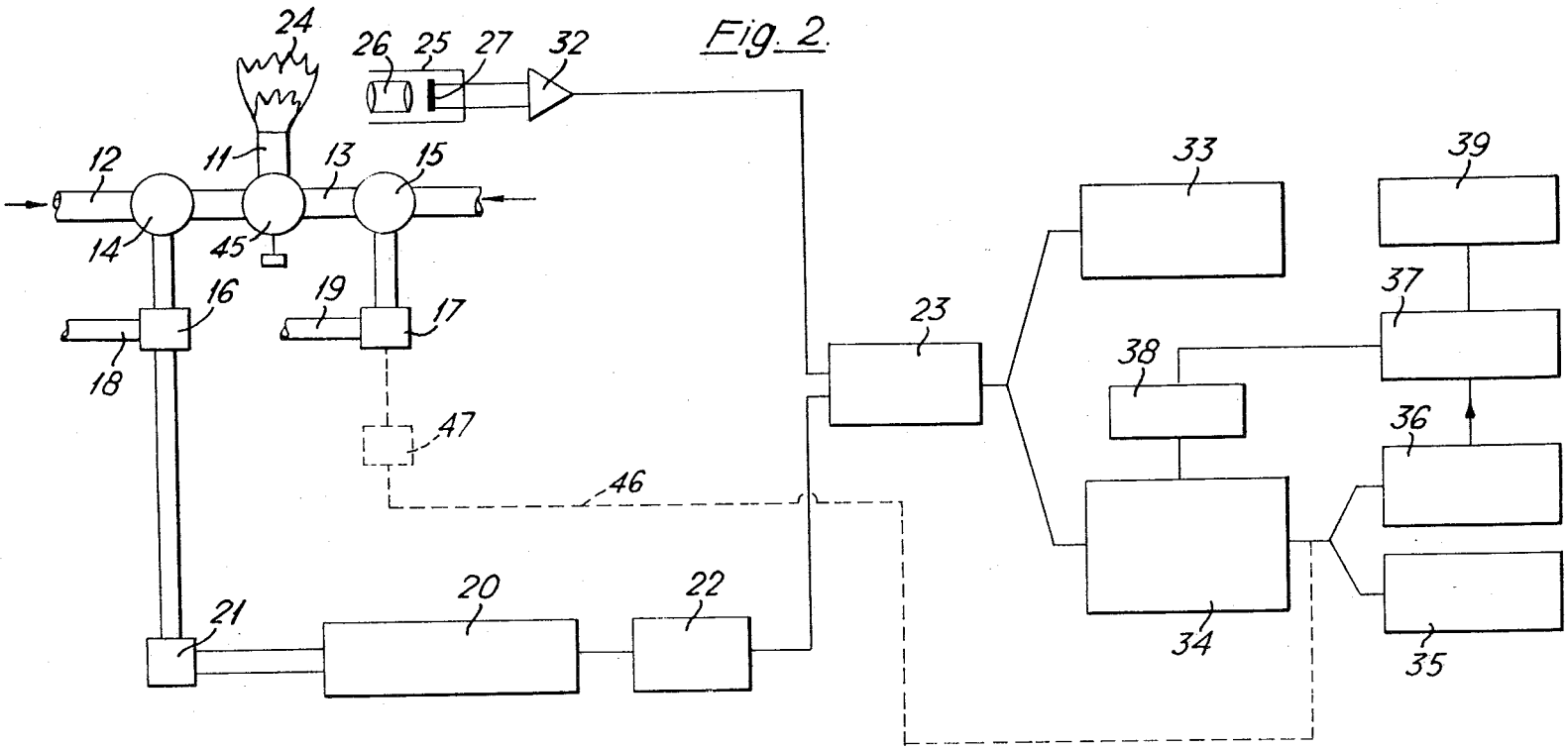
FIG. 2 is a block diagram showing the general components of the burner monitor.

As shown in FIGS. 1 and 2, a boiler 10 is shown provided with three gas burners 11, although the actual number of burners is unimportant. The burner 11 is supplied with fuel gas through a pipe 12 and air through a pipe 13. The level of flow through the pipe 12 is controlled by a valve 14 and that through the pipe 13 by a valve 15. The valves 14 and 15 are in turn controlled by pneumatically operated actuators 16 and 17 respectively. A pneumatic signal is provided to the actuator 16 through a line 18 for setting the general level of flow in the pipe 12 and another pneumatic signal is provided through a line 19 to the actuator 17 to control the level of flow in the pipe 13. As so far described the burner installation is conventional and it is this installation to which the burner monitor of the invention is fitted.

The monitor itself incorporates an electrical modulation generator 20 which feeds a 1 Hz electrical signal to a transducer 21 and through a delay circuit 22 to a comparator 23. The transducer 21 transmits a 1 Hz pneumatic signal to the actuator 16, superimposed on the signal through the line 18. As a result the flow of reactant through the pipe 12 to the burner 11 is subjected to a small amplitude fluctuation at a frequency of 1 Hz resulting in a flickering of the flame 24 at the same frequency.

A detector 25 is sighted on the burner flame 24 to be monitored and incorporates an optical assembly 26 and a photoelectric sensing element 27.

The optical system 26 uses narrow angle optics designed to sight typically on an area of diameter one foot at a distance of 20 feet. The detector is aligned so as to view the particular flame under evaluation in such a way that the flame always completely fills the field of view, and that the view is uninterupted by other flames.

As shown in FIG. 1, the detector 25 has a housing which is water or air cooled, utilising water or air flow and return pipes 28 and 28*a* respectively. The housing is shown mounted via a universal ball joint 29 and a clamp 29*a* on a fixed rail 30 and is sighted on the appropriate flame 24 through a window opening 31 in the boiler casing 10.

The electrical signal from the sensor 27 is passed through an amplifier stage 32 to the comparator 23 which compares the polarity of any part of the signal, which is at the same frequency as the reference signal received from the modulator 20, with the polarity of the reference signal. The result of this comparison is displayed on a centre zero polarity indicator meter 33. If the reactant supplied through the pipe 12 is the fuel, and the reactant supplied through the pipe 13 is air, the two signals received by the comparator will be in phase if the fuel/air mixture at the burner is fuel lean and anti-phase if the fuel/air mixture at the burner is fuel rich. This follows because the maximum flame radiation intensity will exist when the fuel and air are supplied in stoichiometric proportions. In that event the comparator 23 will provide a null output. Similarly if the reactant supplied through the pipe 12 is the air and the fuel is supplied through the pipe 13, the signals reaching the comparator 23 will be in-phase if the fuel/air mixture reaching the burner is fuel rich and anti-phase if the mixture is fuel lean.

Errors introduced by a phase lag of a fraction of a period, introduced by the different transmission times of the reference signal from the generator 20 to the comparator 23 and the signal from the generator 20 reaching the comparator 23 via the transducer 21, actuator 16, valve 14, and detector 25, are eliminated by introducing a delay into the reference signal. This is achieved by manual adjustment of the delay circuit 22. The circuit 22 also enables a phase lag of 0°, 90° and 180° to be added to the reference signal by operation of a simple switch, for use in setting up procedures as previously described.

The output signal by the comparator 23 is passed to an integrator circuit 34, which integrates the signal with time, and the output of which is displayed on a centre zero quantitative assessment indicator 35. The direction of deflection of this meter relates directly to the relative phase of the reference signal and the detector signal and hence to a fuel rich or fuel lean flame condition. The integrator output is also compared in a comparator 36 against a threshold set in a fixed reference circuit to produce an output pulse from a pulse generator stage when a threshold crossing occurs. The threshold level is preset, for example, at full scale deflection of the meter 35. The pulse controls a latch which provides a time "hold" signal to stop a timer circuit, the timer having counted and displayed one second increments since being reset by a reset switch 38.

Figure 6:
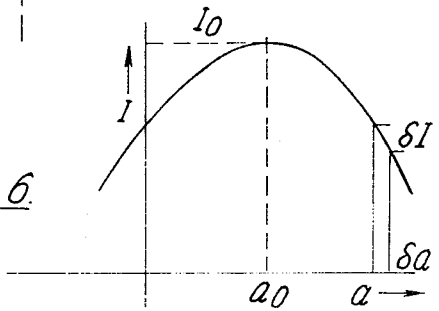

Coincident with the timer hold signal, the latch produces an integrator "clear" signal so that following the hold signal, a digital readout 39 indicates the time taken for the integrator to reach the preset threshold level, and the integrator output resets to zero. The digital readout indicates, by its magnitude, the amount of adjustment required to optimise burner performance. A large number (i.e. a long time lapse) indicates a small error and a condition near to peak efficiency. A small number (i.e. a short time lapse) indicates a large error and a condition further away from peak efficieny. This is supported by the following theory which is to be read in conjunction with FIG. 6.

The radiation intensity "I" from the flame when plotted against fuel/air ratio $a$ exhibits a peak $I_o$ at $a_o$.

A general equation for the peak may be written in the form $$I = b_o + b_1 (a - a_o) + b_2 (a - a_o)^2 + b_3 (a - a_o)^3 + \ldots$$

As a modulation of amplitude $\delta a$ is applied to the fuel air ratio the corresponding fluctuation in radiation intensity is $$\delta I = \delta a \sin\omega t \frac{dI}{da} \left(\begin{array}{c}\omega \text{ is the modulation} \\ \text{frequency}\end{array}\right)$$

$$= [b_1 + 2b_2(a - a_o) + 3b_3(a - a_o)^2 + \ldots]\ \delta a \sin\omega t$$

Since it is known that $$\frac{dI}{da} = 0$$

when $a = a_o$ then $b_1 = 0$ and $$\delta I = [2b_2 (a - a_o) + 3b_3 (a - a_o)^2 + \ldots]\ \delta a \sin\omega t$$

The phase correlator output is basically the multiplication of the applied modulation signal and the resulting intensity fluctuation and may be written:

$$\text{Correlator Output} = [2b_2 (a - a_o) + 3b_3(a - a_o)^2 + \ldots]\delta a^2 \mathrm{Sin}^2\omega t$$

The integral of this becomes the integrator output $$\text{Integrator Output} = \int \frac{T}{o} [2b_2(a - a_o) + 3b_3(a - a_o)^2 + \ldots]\ \delta a^2 \mathrm{Sin}^2\omega t dt$$

and if $\omega T >> \pi$ $$\text{Integrator Output} = [2b_2(a - a_o) + 3b_3(a - a_o)^2 + \ldots]\tfrac{1}{2}\delta a^2 \times T$$

So that to a first approximation, ignoring terms in $b_3$, the time T taken for the integrator to change by a predetermined amount is inversely proportion to the difference between the working fuel air ratio and the peak intensity position $a_o$.

$$T \alpha \frac{1}{(a - a_o)}$$

Figure 5:
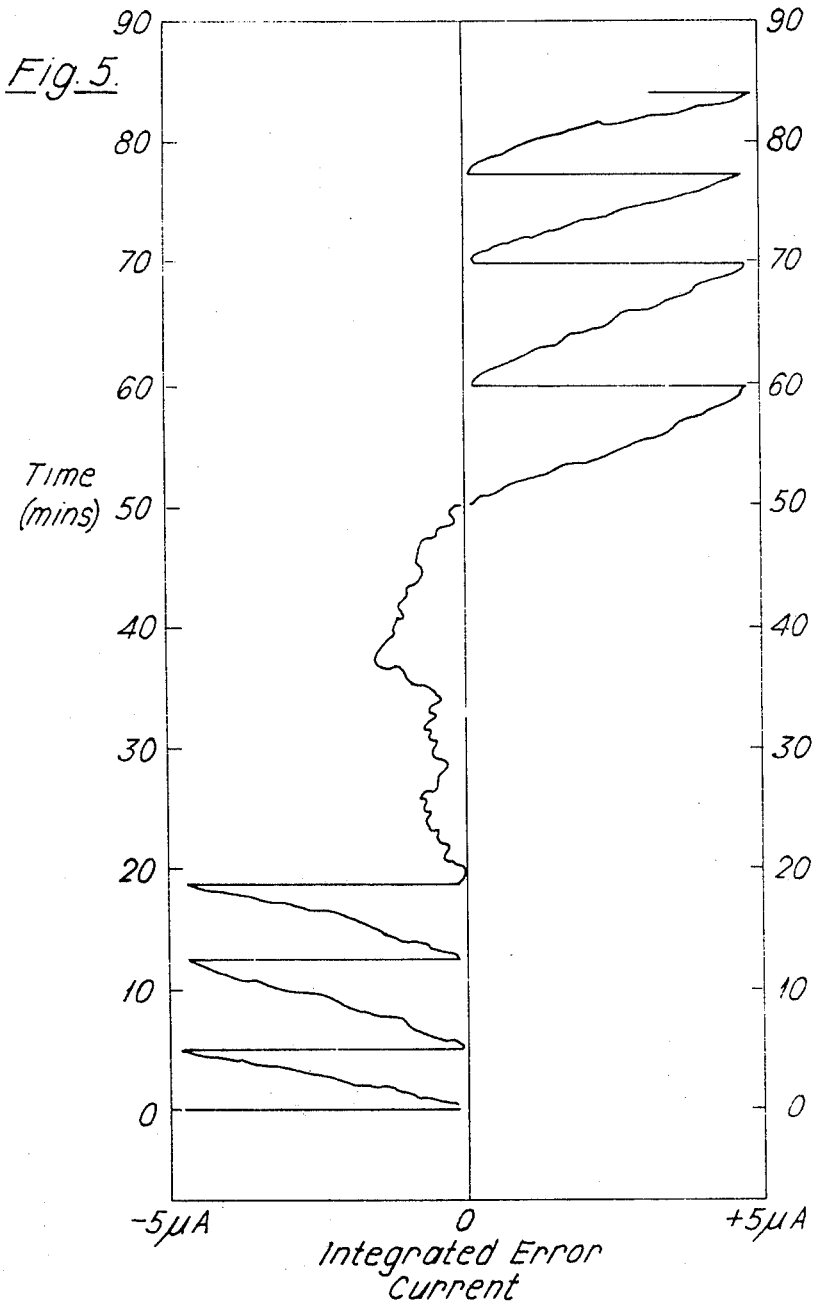
FIG. 5 is an illustration of a continuous trace chart record produced by the monitor; and, FIG. 6 is a graph relating to the theory of operation of the monitor.

The output from the integrator as displayed by the meter 35, may also be displayed as a continuous trace on a moving chart, the integrator and thus the trace automatically being reset by the timer 37 to centre zero when a full scale deflection is reached. Such a continuous chart record is illustrated in FIG. 5, The trace on one side of the centre line represents a fuel rich condition and a trace on the other side of the centre line a fuel lean condition. The time which has elapsed between successive peaks on one side of the centre line is again a representation of the efficiency of the fuel/air mixture at the burner being monitored.

The parts 20 and 22 may be housed in one module 40 which is coupled with a module 41 housing the parts 32, 23, and 33 to 39 inclusive. The module 41 may in turn be connected to a continuous trace chart recorder 42. A cable leads from the module 40 to electropneumatic equipment 43 and the module 41 is in use coupled to the detector 25 through a cable 44.

It is possible for the modules 40 and 41 to be separate items or they may be enclosed together to form a portable monitor. The monitor may be used in conjunction with a single burner installation or with a multiple burner installation in which the burners are provided with separate independent reactant flow control valves 14 and 15 or with common reactant flow control valves 14 and 15. In the latter case a separate manual trimming valve 45 for each burner 11 will be necessary, the trimming adjustment being dependent upon the independent monitoring of the corresponding flame 24.

It is also possible, particularly in single burner installation, for a signal dependent upon the phase assessment, to be fed back from the integrator 34 to adjust the setting of the valve 14 or the valve 15 or of another valve in the pipes 12 or 13 to adjust the reactant flow ratio to the burner 11 to the desired stoichiometric ratio. Such adjustment may be made via a line 46 and adjustment 47 in the case in which it is the setting of the valve 15 which is to be adjusted.

Figure 3:
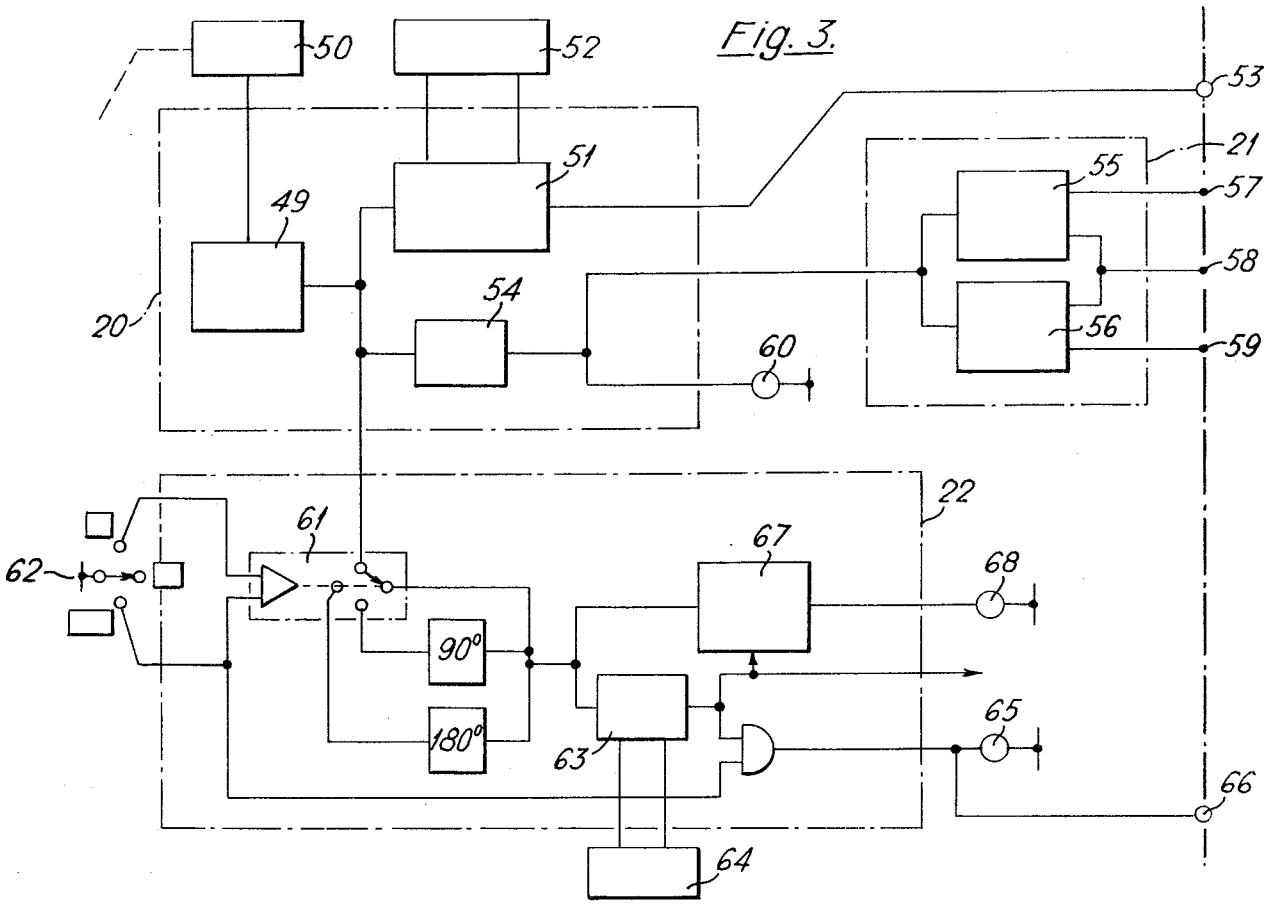
FIG. 3 is a block diagram showing the modulation generator and delay circuit of the monitor.

FIG. 3 illustrates in more details than FIG. 2 the circuitry within the module 40. The modulation generator 20 incorporates an oscillator 49 connected to a frequency control 50. The frequency of the oscillator is determined by an externally accessible manual control. The oscillator produces a square wave output which is split along three paths.

The first path is to a modulator stage 51 provided with a manually adjustable modulation amplitude control 52. The output of the modulator 51 is available at a socket 53 for coupling to the associated electropneumatic control equipment 43. The modulation amplitude control setting determines the output level necessary to operate a particular pneumatic diaphragm and its linked fuel control valve 14. Typically a 3 to 15 p.s.i. control valve requires a drive of 0 to 10 mA.

The oscillator wave output is also buffered by a buffer 54 to two modulating relays 55 and 56 on a servo modulator slave board. The relay contacts are isolated and provide alternate short circuit and open circuit conditions on servo output socket pins 57, 58 and 59. A solenoid supply for associated servo control equipment is connected into the module, switched by the modulating relay contacts and fed out of the module again via the servo output socket. For example, where the solenoid supply is a 110/240, 50 Hz A.C. voltage it is fed and switched D.C. it is fed and switched between pins 58 and 59. The modulation signal is monitored at an LED 60 on a modulator board on a front panel of the module.

The third path for the oscillator wave is via a delay circuit consisting of two parts: a three position switched delay unit 61, having selections of no-phase shift, 90° phase shift, or 180° phase shift by the operation of a front panel 0-90-180 delay selection switch 62; and a variable delay unit 63 incorporating a monostable delay circuit where it is delayed by an amount dependent upon the setting of a manually adjustable delay control 64 on the front panel. The output of the delay circuit is the reference signal which is monitored by an LED 65 on the control panel and is available at an output socket 66 for coupling to the comparator 23 in the module 41.

The input to, and output from, the monostable delay stage 63 is set to an excess delay detection stage 67 which provides an indication by means of an LED 68 of excess delay when more than 180° phase shift conditions occur assuming that the switch delay is 0°. The achievable delay is thus 0° to 180° with switch 61/62 in the 0° position. With the switch set to 90° and 180°, the range of delay is 90° to 270° and 180° to 360° respectively with the excess delay LED 68 indicating the upper limit in all cases. The 0° and 180° switch positions thus offer delays from 0° to 180° and from 180° to 360° to allow for any length of delay in the transmission times of the signals recieved by the comparator 23. The 90° switch position is provided for use during the setting up procedures as described.

Figure 4:
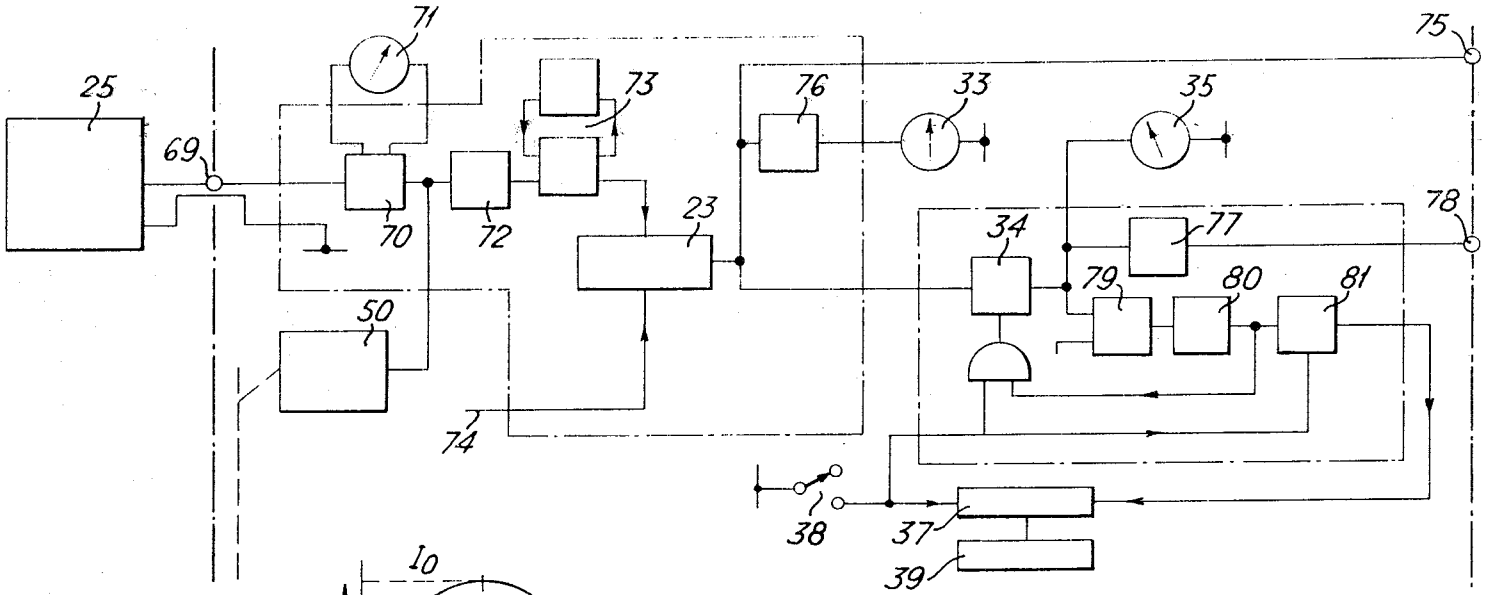
FIG. 4 is a block diagram showing the detector, correlator and indicator circuit of the monitor.

FIG. 4 shows in more detail than FIG. 2 the circuitry in the module 41, together with the detector 25. The signal from the detector 25 enters the module through a socket 69 which feeds into a voltage conversion stage 70 on a detector amplifier board from which a detector current meter reading is obtained at a meter 71. The voltage output from this stage is fed to an A.C. coupling stage 72 which is adjusted by the setting of a variable control on the board. Frequency control is provided from the same control 50 as that shown in FIG. 3 and sets the response of the detector amplifier circuit to extract the required component of the input signals having the same frequency as the reference signal.

Automatic gain control of the detector signal is provided by an AGC loop 73 which controls a variable gain stage in the signal path to regulate the amplitude of the signal presented to the comparator 23.

The reference signal is fed into the comparator 23 through a line 74 which is coupled to the socket 66 in FIG. 3. At the comparator the phase of the two signals are compared to produce a bi-polar D.C. error signal which is a function of the phase correlation. The comparator output is connected as an output at a correlator monitor socket 75, via a smoothing stage 76 to the meter 33, and to an integrator circuit on the controller integrator board. Operation of the reset switch 38 clears both the integrator 34 and the time circuits, resetting both to zero. Following the release of the reset switch 38, which is spring loaded, the integrator integrates the input error signal to provide an integrated signal output to the integrator meter 35; via a current conversion stage 77 to an integrator monitor output socket 78; and to a comparator circuit 36 incorporating the comparator 79, pulse generator 80, and latch 81.

I claim:

1. A burner monitor comprising variator means for producing a determined fluctuation of the flow of a reactant to a burner, detector means for detecting radiation from the flame from said burner and for emitting a signal corresponding to the radiation, comparator means coupled to the variator means and said detector means for assessing the polarity of any correlation between said applied fluctuations and said signal from said detector means, and humanly sensible indicator means coupled to said comparator means for indicating said assessed polarity, said variator means producing periodic fluctuations and said comparator being phase-sensitive detector means for producing an output which has a function of the degree of in phase correlation of two input signals.

2. A monitor according to claim 1, wherein said periodic fluctuations have a frequency between 0.1 and 10 Hz.

3. A monitor according to claim 1, wherein said variator means includes an electrical modulation generator from which a reference signal is fed to said comparator means.

4. A monitor according to claim 3, wherein said modulation generator includes an electro-pneumatic transducer to produce a fluctuating pneumatic signal and a pneumatic actuator responsive to the pneumatic signal for controlling a valve in turn controlling a level of said burner reactant flow.

5. A burner monitor comprising variator means for producing periodic fluctuations of the flow of a reactant to a burner, electrical periodic modulation generator means coupled to said variator means for controlling said variator and forming a reference signal, phase-sensitive comparator, detector means for detecting radiation from the flame of said burner and feeding said comparator means with a signal corresponding to said radiation, said comparator incorporating means for assessing the polarity of any correlation between said reference signal and said signal from said detector means, and an adjustable delay circuit connecting said modulation means to said comparator for delaying said reference signal and applying the reference signal to said comparator.

6. A monitor according to claim 5, in which said periodic fluctuations have a frequency between 0.1 and 10 Hz.

7. A monitor according to claim 5, in which said delay circuit incorporates means controlled by a switch for introducing a 90° phase change into said reference signal.

8. A monitor according to claim 7, further comprising means controlled by a switch for incorporating a 180° phase change into said reference signal.

9. A burner monitor comprising variator means for producing a determined fluctuation of the flow of a reactant to a burner, detector means for detecting radiation from the flame from said burner and for emitting a signal corresponding to said radiation, comparator means coupled to the variator means and said detector means for assessing the polarity of any correlation between said applied fluctuations and said signal from said detector, integrator means coupled to said comparator for integrating said comparator output, and a visual quantative assessment indicator coupled to said integrator means and having means to display an integrated output.

10. A monitor according to claim 9, wherein said variator means produces periodic fluctuations and said comparator means is a phase-sensitive detector means for producing an output which is a function of the degree of in-phase correlation of two input signals.

11. A monitor according to claim 10, wherein said periodic fluctuations have a frequency between 0.1 and 10 Hz.

12. A monitor according to claim 10, wherein an electrical modulation generator in said variator means controls said variator means and feeds a reference signal to said comparator.

13. A monitor according to claim 12, further comprising an adjustable delay circuit between said modulation generator and said comparator means for delaying said reference signal.

14. A monitor according to claim 13, wherein said delay circuit incorporates means controlled by a switch for introducing a 90° phase change into said reference signal.

15. A monitor according to claim 14, further comprising switch responsive means in said delay circuit for introducing a 180° phase change into said reference signal.

16. A monitor according to claim 9, further comprising a timer coupled to said integrator means and adapted to record automatically the time taken for the integrated comparator output to reach a predetermined value.

17. A monitor according to claim 16, wherein said timer is a digital clock provided with a manual reset.

18. A monitor according to claim 9, wherein said quantative assessment indicator is a centre zero meter.

19. A monitor according to claim 9, wherein said quantative assessment indicator includes charter recorder means for producing a continuous trace corresponding to said quantitative assessment indicator display.

20. A monitor according to claim 19, wherein said chart recorder means incorporates means for resetting said trace to centre zero on reaching a predetermined deflection.

21. In a multiburner installation incorporating a monitor for monitoring the reactant ratio at an individual burner, the improved burner monitor which comprises valve means for controlling flow of the reactant to said burner, variator means coupled to the valve for producing a periodic fluctuation of the setting of said valve and hence the corresponding fluctuation of said burner reactant flow, electrical modulation generator means coupled to said variator means for controlling said variator means and producing a reference signal, phase-sensitive comparator, detector means incorporating an optical system sighted on a flame of said burner for feeding to said comparator a signal corresponding to radiation from said burner flame, adjustable delay circuit means coupled between said modulation generator means and said comparator for delaying said reference signal, said comparator including means for assessing the polarity of any correlation between said reference signal and said signal from said detector means and producing a comparator output, integrator means coupled to said comparator for integrating said comparator output, and humanly visible quantative assessment indicator means coupled to said comparator for displaying an integrated assessed polarity.

22. A burner installation according to claim 21, wherein adjustable mounting means holds said detector means for enabling said detector means to be adjusted in position and sighted successively on different burner flames.

23. A burner installation according to claim 22, wherein said detector means is housed in a water cooled housing.

24. A burner installation according to claim 22, wherein said detector means is housed in an air cooled housing.

* * * * *